US005504798A

United States Patent [19]

Suzuki

[11] Patent Number: 5,504,798

[45] Date of Patent: Apr. 2, 1996

[54] X-RAY GENERATION TUBE FOR IONIZING AMBIENT ATMOSPHERE

[75] Inventor: Kenji Suzuki, Hamamatsu, Japan

[73] Assignee: Hamamatsu Photonics K. K., Shizuoka, Japan

[21] Appl. No.: 259,684

[22] Filed: Jun. 13, 1994

[30] Foreign Application Priority Data

Jun. 18, 1993 [JP] Japan ..... 5-148006

[51] Int. Cl.[6] ..... H01J 35/00

[52] U.S. Cl. ..... 378/136; 378/121; 378/143

[58] Field of Search ..... 378/136, 119, 378/121, 122, 137, 138, 143

[56] References Cited

U.S. PATENT DOCUMENTS

| | | | |
|---|---|---|---|
| 3,138,729 | 6/1964 | Henke | 313/57 |
| 4,670,894 | 6/1987 | Birnbach et al. | 378/136 X |

FOREIGN PATENT DOCUMENTS

| | | | |
|---|---|---|---|
| 1064649 | 9/1959 | Germany | H01J 35/02 |
| 2421119 | 11/1975 | Germany | H01J 35/08 |
| 12-5501 | 6/1937 | Japan . | |
| 62-44936 | 2/1987 | Japan | H01J 27/24 |
| 2297850 | 12/1990 | Japan | H01J 35/08 |
| 357978 | 9/1931 | United Kingdom | H01J 35/32 |
| 548673 | 10/1942 | United Kingdom | H01J 35/02 |
| WO9209998 | 6/1992 | WIPO | H01J 35/00 |

*Primary Examiner*—David P. Porta

*Attorney, Agent, or Firm*—Sughrue, Mion, Zinn, Macpeak & Seas

[57] ABSTRACT

An X-ray generation tube capable of providing gas ionization to ambient atmosphere in a wide area by radiating X-rays in various directions. The X-ray generation tube includes a container body formed of an X-ray transmittable material. The container body has a linear cylindrical shape or a circular shape. A target membrane is formed at an entire inner surface of the container body for receiving electrons and emitting X-rays. Bases are provided at both ends of the container body and have pins. A cathode is supported by the pins and is disposed at a central axis of the container body for generating the electrons. Since the distances between any one of the points on the target membrane and the cathode are equal with respect to a cross-section or the radial direction of the container body, and since the target membrane is provided at the entire inner surface of the container body, X-rays can be radiated from the entire outer surface of the container body in a uniform manner, resulting in uniform radiation.

23 Claims, 7 Drawing Sheets

X-RAY GENERATION TUBE FOR IONIZING AMBIENT ATMOSPHERE

BACKGROUND OF THE INVENTION

The present invention relates to a transmission type X-ray generation tube having an X-ray window and a target, and more particularly, to a tube capable of providing ionization to ambient atmosphere.

Recently, gas ionization to the ambient air or gas is required for neutralization of a charged particle, or for providing a negative ion atmosphere for human comfort. Further, positive gas ionization is also used for sterilization of the ambient atmosphere.

To this effect, Japanese Patent Application Kokai No. Sho-62-44936 discloses an ion beam generation system provided with a synchrotron radiation device. However, no proposals have yet been made in connection with the employment of the transmission type X-ray generation tube for this purpose.

RELATED ART

A transmission type X-ray generation tube has been known which generates a relatively weak X-ray having a specific wavelength for the purpose of analysis of a substance or diagnosis. In this case, the image pick-up is accomplished by concentrating X-rays to a desired limited area.

The conventional transmission type X-ray generation tube includes a cathode which releases electrons, a grid for controlling the orientation of the electrons, a transmission type target which receives the electrons at one of its surfaces and emits X-rays from opposite surface, and an X-ray transmission window for releasing the X-rays outside. These are accommodated in a cylindrical hermetic container body. Such a conventional tube is disclosed in Japanese Patent Application Kokoku No. Sho-37-5501 and Japanese Patent Application Kokai No. Hei-2-297850.

In such a conventional transmission type X-ray generation tube, the X-rays are to be radiated to a limited specific area for the image pick-up. Therefore, the grid is used for directing the generated electrons to a concentrated area in order to provide a point radiation source. In this case, several electrons generated from the cathode may not reach the target due to inaccuracy in control by the grid. Such a conventional X-ray generation tube may not be available for providing an ionization atmosphere for an extended or wide area.

SUMMARY OF THE INVENTION

It is therefore, an object of the present invention to provide an X-ray generation tube capable of efficiently providing ionization atmosphere within an extended wire area.

This and other objects of the present invention will be attained by providing an X-ray generation tube for radiating X-rays toward a wide area to ionize an ambient gas. The X-ray generation tube comprises a container body, first and second bases, a cathode and a target. The container body is formed of an X-ray transmittable material and has an inner peripheral surface and first and second open ends. The container body has a tubular shape which has a circular cross-section. The tubular shape defines therein a central axis extending in a lengthwise direction thereof and at a position coincident with a center of the cross-sectional circle. The first base plugs the first open end of the tubular container body, and implants therein a first pin. The second base plugs the second open end of the tubular container body, and implants therein a second pin. The cathode has one end supported by the first pin and another end supported by the second pin, for generating electrons. The target membrane is formed at the entire inner peripheral surface of the container body for emitting X-rays upon receipt of the electrons. The distances between any one of the points on the target membrane and the cathode are equal to one another with respect to the cross-section.

With this structure, extensive amounts of X-rays can be radiated from the outer surface of the container body because of the extended area of the target membrane, where all electrons generated at the cathode can reach the target membrane. Further, uniform radiation density per unit area of the outer surface of the container body -results, because of the equi-distant arrangement between any point on the target membrane and the cathode in a radial direction of the tube.

BRIEF DESCRIPTION OF THE DRAWINGS

In the drawings;

FIG. 6(*b*) is a cross-sectional view taken along the line VI—VI of FIG. 6(*a*);

FIG. 7(*b*) is a cross-sectional view taken along the line VII—VII of FIG. 7(*a*);

FIG. 8(*b*) is a cross-sectional view taken along the line VIII—VIII of FIG. 8(*a*).

DETAILED DESCRIPTION OF THE PREFERRED EMBODIMENTS

Figure 1:
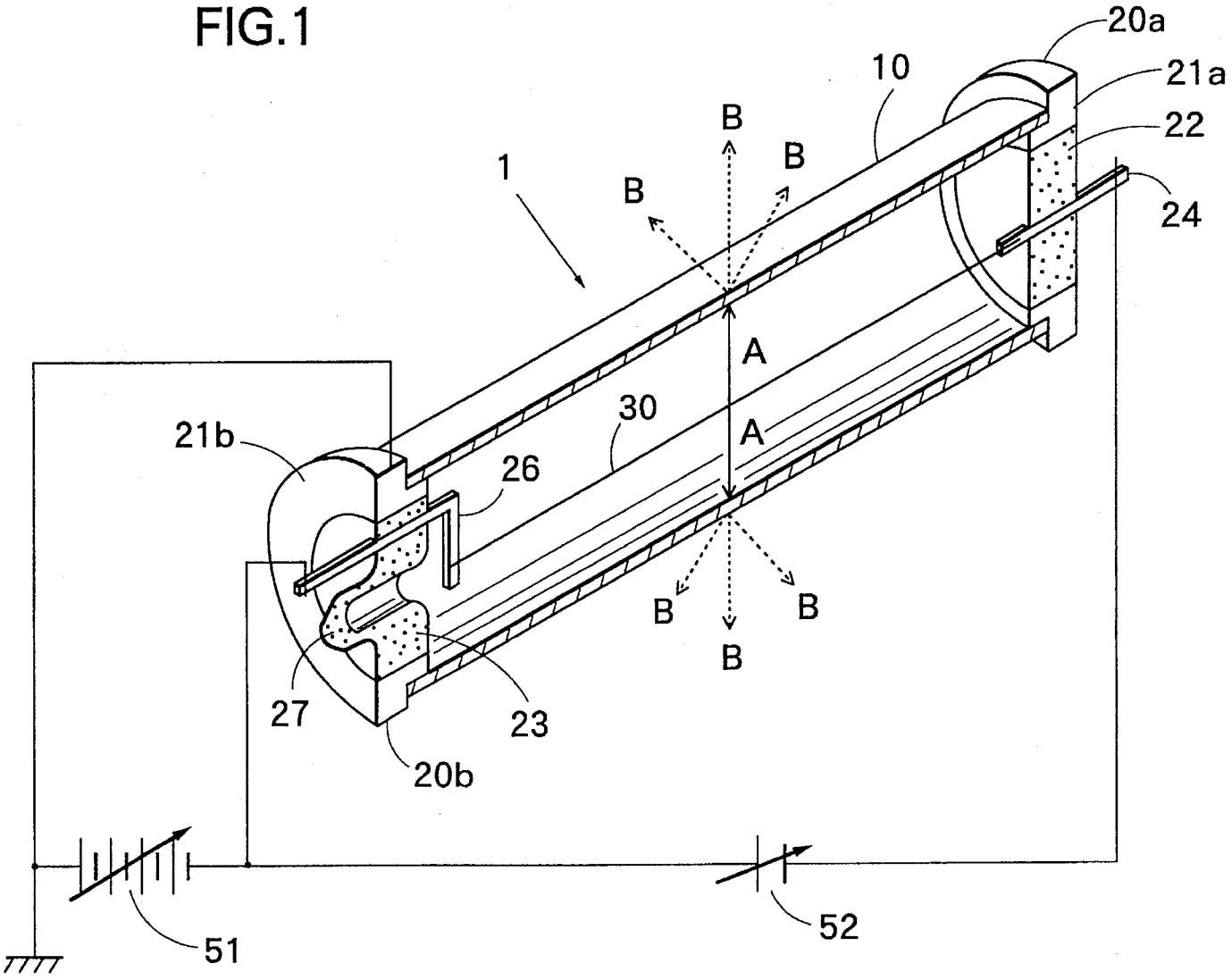
FIG. 1 is a perspective view showing a cross-section of an X-ray generation tube according to a first embodiment of the present invention.
Figure 2:
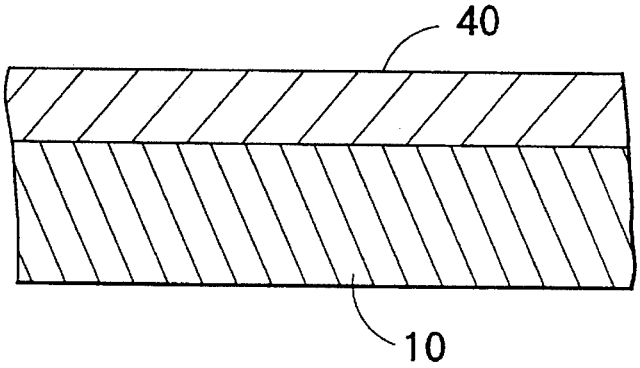
FIG. 2 is a partially enlarged cross-sectional view showing a wall of a container body of the X-ray generation tube according to the first embodiment of the present invention.

An X-ray generation tube according to a first embodiment of the present invention will be described with reference to FIGS. 1 and 2.

The X-ray generation tube 1 generally includes a container body 10 having a cylindrical shape, both of whose ends are open, a target membrane 40 formed on an inner peripheral surface of the container body 10, bases 20*a*, 20*b* provided at open ends of the container body 10, and a cathode 30 positioned concentrically with the container body 10.

The container body 10 serves as a target and also as an X-ray transmission window. Approximately vacuum pressure is maintained in an interior of the container body 10. The container body 10 is formed of an X-ray transmittable material having high heat conductivity, such as beryllium, glassy carbon (graphite), polyimide, aluminum and boron nitride. The thickness of the container body is in a range of from 200 micrometers to 1 mm for beryllium, and from 200 micrometers to 500 micrometers carbon and aluminum. Therefore, the container body 10 has a proper mechanical strength. The container body 10 has an available diameter of 25 to 40 mm, and an available length of 30 to 150 mm.

The target membrane 40, which emits X-rays upon receipt of the electrons, is formed on the inner surface of the container body 10 by either a vacuum deposition method or plating. The thickness of the target membrane is dependent on the constituent material. However, the thickness is preferably minimal, yet capable of emitting the X-rays. With such an arrangement, X-ray absorption in the target membrane can be restrained to a minimum level. Even though the target membrane 40 has a minimum thickness, the target membrane 40 may not be easily bent since it is held by the container body 10 having a proper mechanical strength. Therefore, uniformity in generating the X-rays from the target can be improved. Further, heat radiation of the target membrane can be improved by using a material having high thermal conductivity in manufacturing the container body 10.

Tungsten is used as the material of the target membrane 40. For tungsten, the thickness of the membrane is in a range of 500 to 3000 Angstroms. Materials other than tungsten are also available, such as titanium, copper, iron, chromium, rhodium, etc.

The first base 20*a* plugging one open end of the cylindrical container body 10 includes an outer body 21*a* formed of a metal and serving as an electrode and having a central circular hole, and a stem 22 fitted in the central circular hole. A first pin 24 is implanted in central portion of the stem 22. The second base 20*b* plugging another open end of the container body 10 includes an outer body 21*b* formed of a metal and serving as an electrode and having a central circular hole, and a stem 23 fitted in the central circular hole and provided with a hollow convex portion 27 at a center thereof. An L-shaped pin 26 is implanted in a portion adjacent the convex portion 27 of the stem 23. Incidentally, the convex portion 27 is formed when providing a vacuum in the container body 10.

The outer body 21*b* is supplied with from 3 to 20 KV direct electrical current from a direct electrical current source 51. The pins 24 and 26 are supplied with several volts direct electrical current from the direct electrical current source 52. Incidentally, in the illustrated embodiment, direct current is used. However, alternating electrical current is also available as the electrical current applied to the outer body 21*b* and pins 24, 26. Further, the outer body 21*b* is grounded. Instead, however, the pins 24, 26 can be grounded.

The cathode 30 extends linearly and is supported by the pins 24 and 26, and is positioned concentrically with the center axis of the container body 10. Accordingly, the distances between the target membrane 40 and the cathode 30 are equal to one another at any location with respect to a radial direction of the container body 10. The cathode 30 is formed of a tungsten wire.

Figure 3:
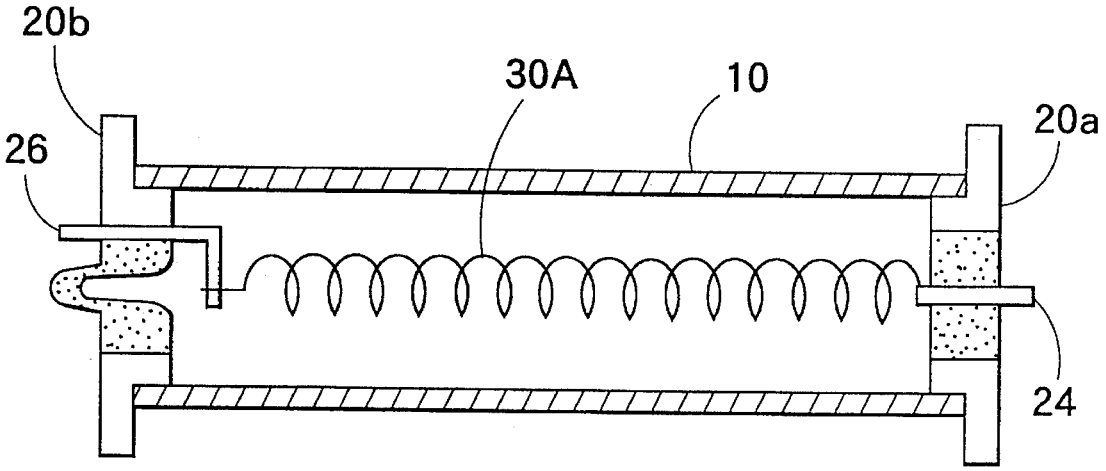
FIG. 3 is a cross-sectional view showing a modification to the first embodiment with respect to an arrangement of the cathode.
Figure 4:
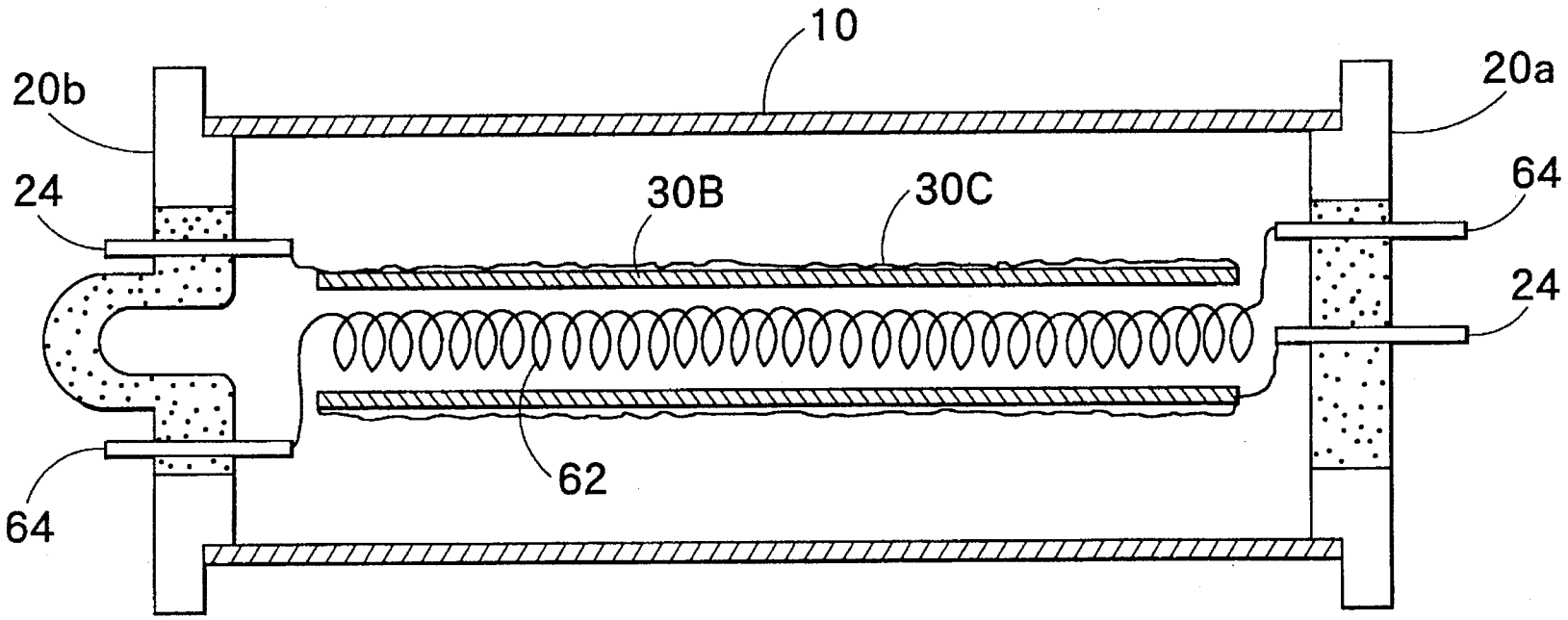
FIG. 4 is a cross-sectional view showing an another modification to the first embodiment with respect to an arrangement of the cathode.
Figure 5:
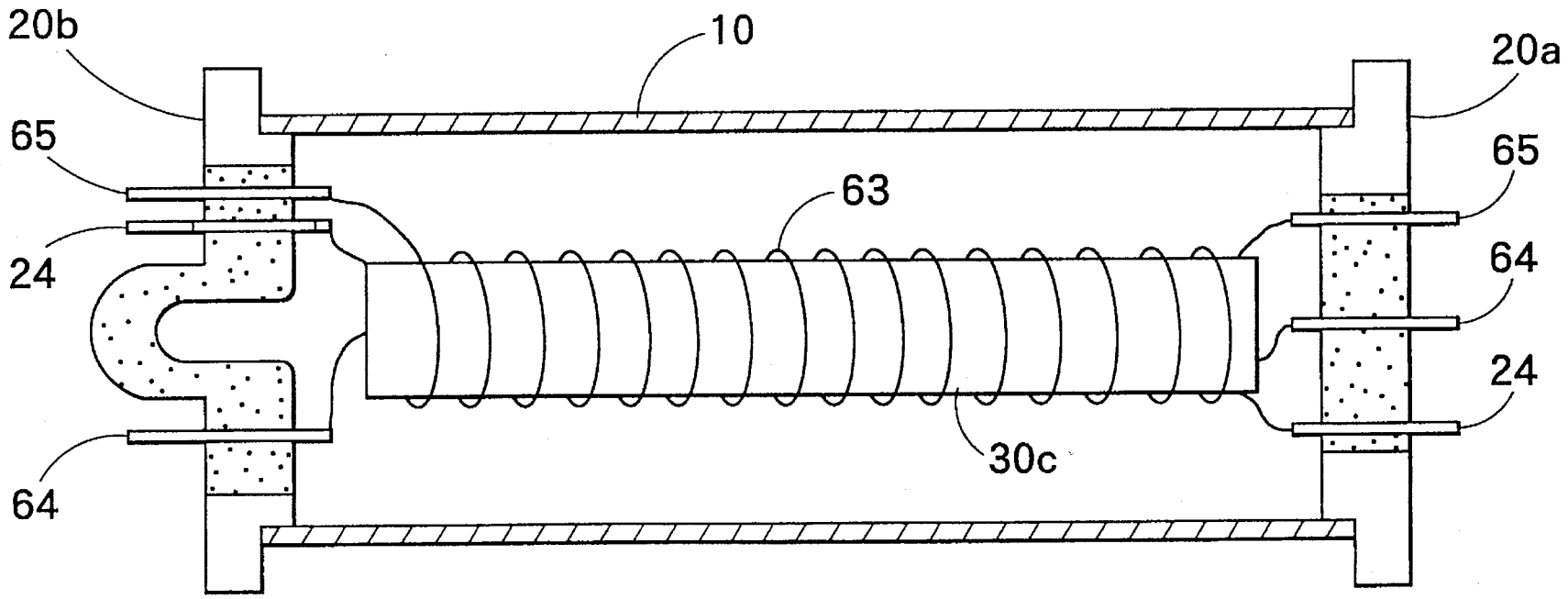
FIG. 5 is a cross-sectional view showing still another modification to the first embodiment with respect to an arrangement of the cathode.

Various modification to the cathode are shown in FIGS. 3 through 5. In the first modification shown in FIG. 3, a cathode 30A is formed by spirally winding a tungsten wire. In this case, a spiral center is positioned coincident with the central axis of the container body 10, so that the distance between the target membrane and the cathode wire 30A stays constant with respect to the radial direction of the container body 10. By the employment of the spirally winding cathode 30A, the electron releasable area can be increased, so that the X-ray generation amount can be increased.

In a second modification shown in FIG. 4, a cathode is provided by a hollow cylinder 30B formed of a metal such as a nickel or a ceramic material, and a oxide cathode material layer 30C (BaO-CaO-SrO-MgO) coated over an outer peripheral surface of the hollow cylinder 30B. The hollow cylinder 30B is supported by the pins 24, 24 in such a manner that the hollow cylinder 30B is coaxial to with the cylindrical container body 10. A heater 62 is disposed in an interior of the cylinder 30B. In this case, another set of pins 64, 64 must be implanted on the bases 20*a*, 20*b* for supplying an electrical current to the heater 62. By providing the heater 62, heating of the cathode 30B, 30C is promoted, to thus promote generation of electrons therefrom.

In a third modification shown in FIG. 5, a cylindrical cathode 30C is coaxial with the container body 10, similar to the second modification. Further, a grid 63 is spirally disposed over the cylindrical cathode in a concentrical relation thereto. With this structure, electrical current directed from the cathode to the target (target current) can be controlled by controlling electrical voltage applied to the grid 63 in order to control X-ray radiation amount. Another set of pins 65, 65 must be implanted in the bases 20*a* and 20*b* for supporting the grid 63.

As a material of the cathode, barium-impregnated tungsten is also available. Further, it is possible to use a cold cathode material or field emitter material such as MgO which may be coated on an outer peripheral surface of a hollow cylinder. Incidentally, if the cold cathode material such as MgO is used as the material of the cathode, a prolonged service life of the cathode can be provided.

Next, operation in the X-ray generation tube according to the first embodiment will be described. Electric power is applied to the cathode 30 from the direct electric current source 52, for heating the cathode 30, to thus release electrons from the cathode. On the other hand, the target membrane 40 also serves as an electron accelerator. If a potential difference is provided between the target membrane 40 and the cathode 30 upon supplying of electrical power to the target 40 from the direct current source 51, the released electrons are accelerated and impinged on the target membrane 40 at high speed, as shown by arrows A. Upon receipt of the electrons, the target membrane 40 emits X-rays which are inherent to the material of the target membrane. Since the container body 10 is of a cylindrical shape formed of X-ray transmittable beryllium, the X-rays can be radiated outwardly as shown by arrows B from an entire outer surface of the container body 10. As a result, the X-rays can be radiated toward a -wide area from along the outer surface of the container body 10.

Further, when viewing a vertical cross-section or a radial direction of the container 10, the radial distance between any point on the target membrane 40 and the cathode 30 are equal to one another. Therefore, most of the electrons generated at the cathode can be uniformly impinged onto the target membrane. Consequently, electrons are efficiently utilized homogeneously.

Figure 6:
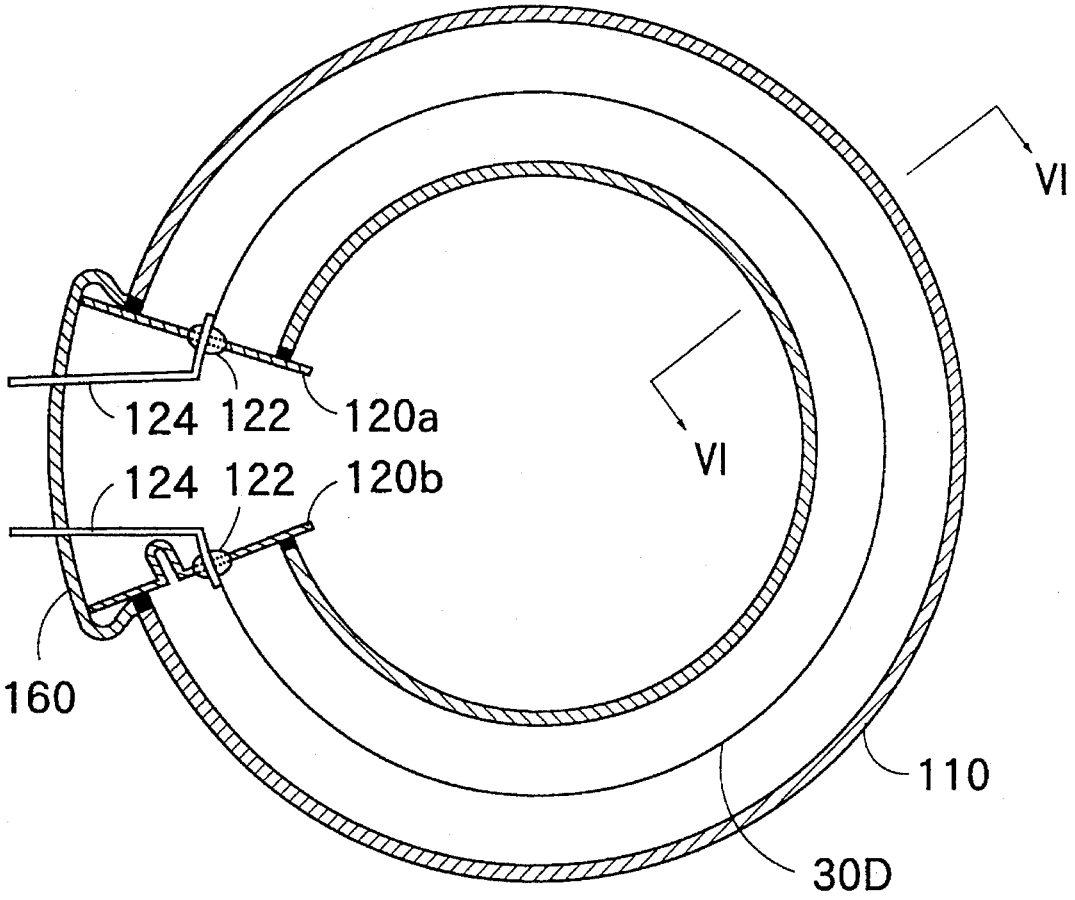
FIG. 6(*a*) is a cross-sectional view showing an X-ray generation tube according to a second embodiment of the present invention.
Figure 6:
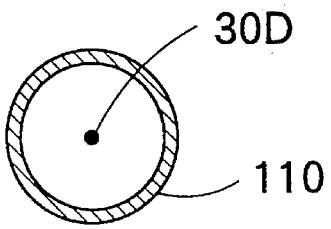

An X-ray generation tube according to a second embodiment of the present invention will next be described with reference to FIGS. 6(*a*) and 6(*b*). The second embodiment differs from the first embodiment in that, in the first embodiment, the tubular container body 10 has a linear arrangement, whereas in the second embodiment, as shown in FIG. 6(*a*), a tubular container body 110 has a ring-like or annular arrangement. Correspondingly, a cathode 30D has a circular shape, formed using a circular tungsten wire. Because of the ring-like shape, the open ends of the container body 110 face each other, so that bases 120*a* and 120*b* also face each other. Accordingly configurations of the bases 120*a*, 120*b*, and stems 122 and pins 124 are different from those of the first embodiment.

Further, in the second embodiment, a ceramic cover 160 is disposed around the bases 120*a*, 120*b* for the purpose of making it easy to connect the pins 124 to a socket. Incidentally, a diameter of the tube of the container body 110 of the X-ray generation tube in the second embodiment is in a range of from 25 mm to 40 mm, and a diameter of the ring, the diameter being measured along a center axis of the tube, is in a range of from 50 mm to 150 mm.

The remainder of the arrangement is basically the same as that of the first embodiment. Particularly, the concept of an equal distance between the target membrane and the cathode 30D at any location of the target membrane is the same. Further, material of the container body 110 is the same as that of the first embodiment such as beryllium, graphite, polyimide, boron nitride, and aluminum.

Therefore, the second embodiment performs its operation similar to that of the first embodiment. That is, X-rays can be radiated, with uniform density, toward the wide area from the annular outer peripheral surface of the container body 110.

Incidentally, modifications to the second embodiment may be conceivable as described above in connection with the first embodiment. That is, the cathode can be provided by spirally winding a tungsten wire, and a material of the cathode could be barium-impregnated tungsten, or a cold cathode material such as MgO can be coated on an outer peripheral surface of a hollow ring-like member.

Figure 7:
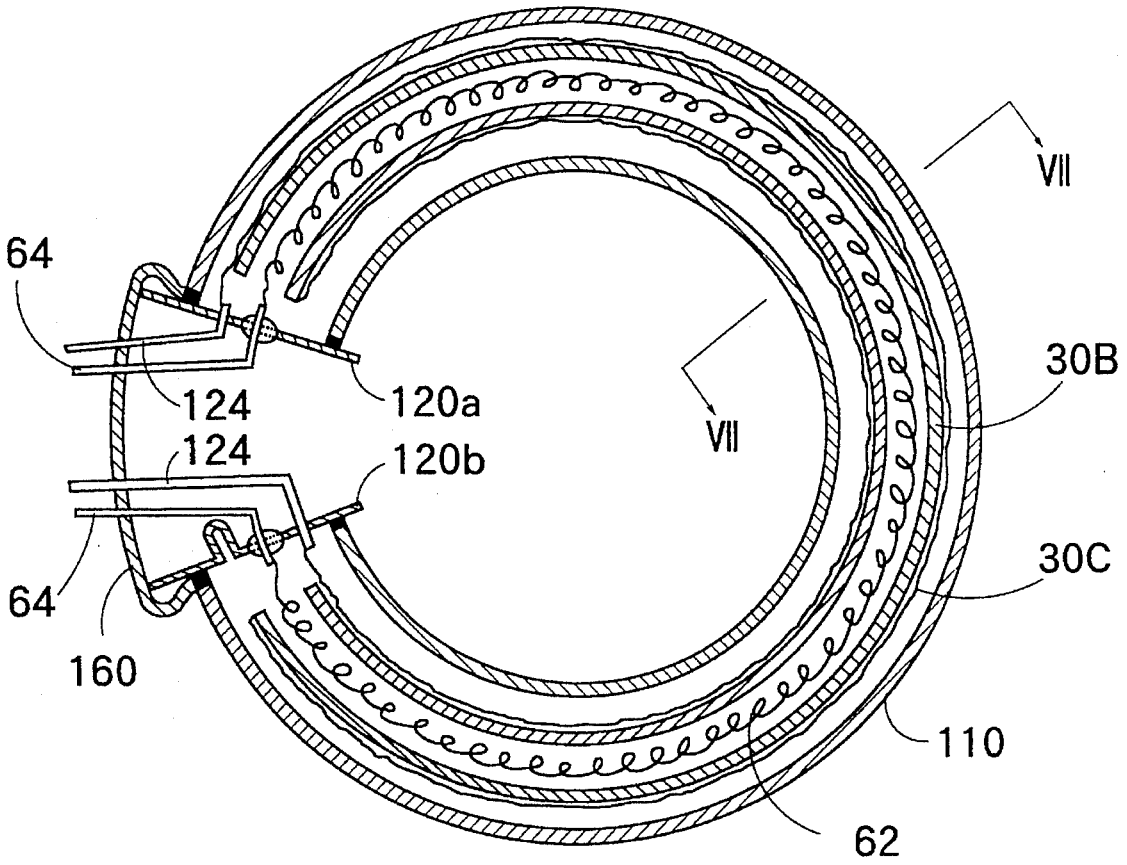
FIG. 7(*a*) is a cross-sectional view showing an X-ray generation tube according to one modification to the second embodiment.
Figure 7:
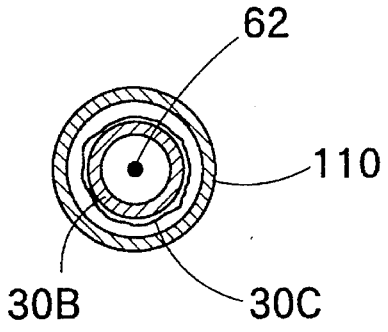

Further, as shown in FIGS. 7(*a*) and 7(*b*), a cathode can be provided by a toroidal member or a tubular ring-like member formed of a metal such as a nickel or a ceramic material and an oxide cathode material (BaO-CaO-SrO-MgO) coated over an outer peripheral surface of the tubular ring-like member. The cathode includes a hollow ring-shaped tubular member 30B disposed concentrically with the ring-shaped container body 110. The cathode is connected to the first and the second pins 124, 124. The hollow ring shaped tubular member 30B has an outer peripheral surface coated with a cathodic oxide material 30C and has an inner hollow space disposing therein a heater 62.

Figure 8:
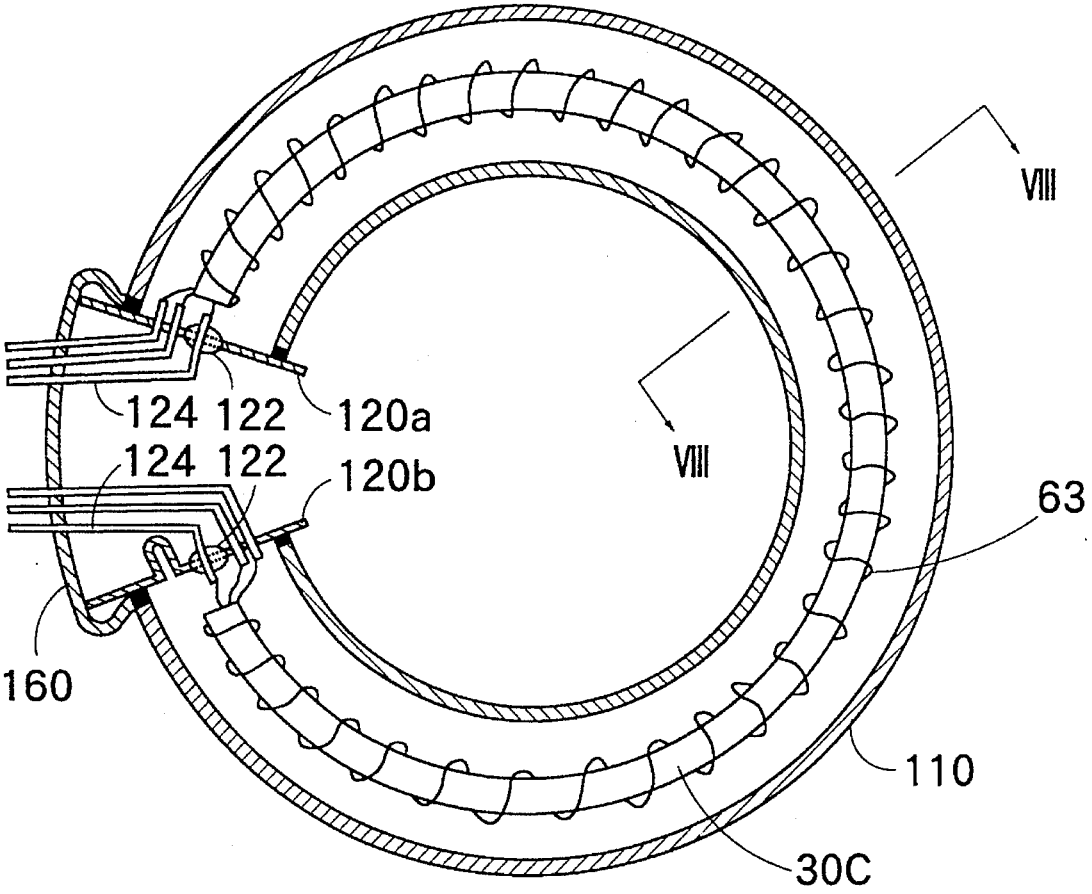
FIG. 8(*a*) is a cross-sectional view showing an X-ray generation tube according to another modification to the second embodiment.
Figure 8:
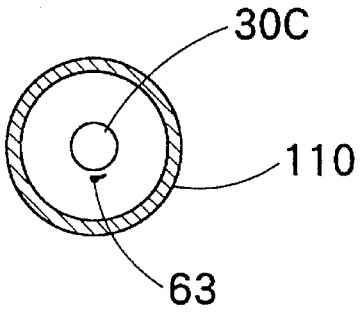

Furthermore, as shown in FIGS. 8(*a*) and 8(*b*), a cathode 30C of a toroidal shape is provided in the ring-shaped container body 110, and a grid 63 is spirally disposed over the toroidal cathode. The spiral center of the grid 63 is coincident with the central circular axis of the cathode 30C.

As described above in detail, in the present invention, the target membrane is formed over the entire inner surface of the container body, so a wide radiation area is provided, and most of the electrons generated at the cathode can be uniformly impinged onto the target membrane because of the equi-distant arrangement between the target membrane and the cathode. Therefore, X-rays can be radiated toward an extended region, and electron utilizing efficiency can be enhanced. As a result, ionization to ambient atmosphere can be efficiently achieved. Further, since X-ray generation efficiency can be improved, an overall apparatus which accommodates the X-ray generation tube can have a compact size, and power saving apparatus can result.

While the invention has been described in detail and with reference to specific embodiments thereof, it would be apparent to those skilled in the art that various changes and modifications may be made without departing from the spirit and scope of the invention.

What is claimed is:

1. An X-ray generation tube for radiating X-rays toward a wide area to ionize an ambient gas, comprising:

a container body formed of an X-ray transmittable material and having an inner peripheral surface and first and second open ends, the container body having a tubular shape which has a circular cross-section, the tubular shape defining therein a central axis extending in a lengthwise direction thereof and at a position coincident with a center of the cross-sectional circle, the container body also having a wall with a thickness ranging from 200 microns to 1 mm;

a first base plugging the first open end of the tubular container body, the first base implanting therein a first pin;

a second base plugging the second open end of the tubular container body, the second base implanting therein a second pin;

a cathode having one end supported to the first pin and another end supported to the second pin for generating electrons; and a target membrane formed at an entirety of the inner peripheral surface of the container body for emitting X-rays upon receipt of the electrons, a distance between any one of the points on the target membrane and the cathode being equal to one another with respect to the cross-section.

2. The X-ray generation tube as claimed in claim 1, wherein the cathode is positioned at and extending along the central axis.

3. The X-ray generation tube as claimed in claim 2, wherein the container body comprises a linear cylindrical member, with the central axis extending linearly.

4. The X-ray generation tube as claimed in claim 3, wherein the container body is formed of a material selected from the group consisting of beryllium, graphite, polyimide, boron nitride, and aluminum.

5. The X-ray generation tube as claimed in claim 2, wherein the container body comprises a ring-like member, the central axis thereof extending circularly, and wherein the first and second open ends are being positioned in a confronting relation, and the first and the second bases are positioned in a confronting relation.

6. The X-ray generation tube as claimed in claim 1, wherein the target membrane has a thickness ranging from 500 to 3000 Angstroms.

7. The X-ray generation tube as claimed in claim 3, wherein the cathode is in the form of a linear wire.

8. The X-ray generation tube as claimed in claim 3, wherein the cathode is in a spiral form.

9. The X-ray generation tube as claimed in claim 3, wherein the cathode is formed of a material selected from the group consisting of tungsten, barium-impregnated tungsten and a cold cathode material.

10. The X-ray generation tube as claimed in claim 3, wherein the cathode comprises a hollow cylindrical member connected to the first and the second pin, the hollow cylindrical member having an outer peripheral surface coated with a cathodic oxide material and having an inner hollow space disposing therein a heater.

11. The X-ray generation tube as claimed in claim 10, wherein the hollow cylindrical member is formed of one of a metal and ceramic material.

12. The X-ray generation tube as claimed in claim 11, further comprising a grid spirally disposed over the cathode, a spiral center of the grid being coincident with a central axis of the cathode.

13. An X-ray generation tube for radiating X-rays toward a wide area to ionize an ambient gas, comprising:

a container body formed of an X-ray transmittable material and having an inner peripheral surface and first and second open ends, the container body having a tubular shape which has a circular cross-section, the tubular shape defining therein a central axis extending in a lengthwise direction thereof and at a position coincident with a center of the cross-sectional circle;

a first base plugging the first open end of the tubular container body, the first base implanting therein a first pin;

a second base plugging the second open end of the tubular container body, the second base implanting therein a second pin;

a cathode having one end supported to the first pin and another end supported to the second pin for generating electrons, said cathode being positioned at and extending along said central axis;

a target membrane formed at an entirety of the inner peripheral surface of the container body for emitting X-rays upon receipt of the electrons, a distance between any one of the points on the target membrane and the cathode being equal to one another with respect to the cross-section;

wherein the container body comprises a ring-like member, the central axis thereof extending circularly, and wherein the first and second open ends are positioned in a confronting relation, and the first and the second bases are positioned in confronting relations.

14. The X-ray generation tube as claimed in claim 5, wherein the container body is formed of a material selected from the group consisting of beryllium, graphite, polyimide, boron nitride, and aluminum.

15. The X-ray generation tube as claimed in claim 13, wherein a wall of the container body has a thickness ranging from 200 microns to 1 mm.

16. The X-ray generation tube as claimed in claim 15, wherein the target membrane has a thickness ranging from 500 to 3000 Angstroms.

17. The X-ray generation tube as claimed in claim 13, wherein the cathode is in the form of a circular wire positioned coaxially with the circular central axis.

18. The X-ray generation tube as claimed in claim 13, wherein the cathode is in a spiral form.

19. The X-ray generation tube as claimed in claim 13, wherein the cathode is formed of a material selected from the group consisting of tungsten, barium-impregnated tungsten and a cold cathode material.

20. The X-ray generation tube as claimed in claim 13, wherein the cathode comprises a hollow ring shaped tubular member disposed concentrically with the ring-shaped container body, the cathode being connected to the first and the second pins, the hollow ring shaped tubular member having an outer peripheral surface coated with a cathodic oxide material and having an inner hollow space disposing therein a heater.

21. The X-ray generation tube as claimed in claim 20, wherein the hollow ring shaped tubular member is formed of one of a metal and ceramic.

22. The X-ray generation tube as claimed in claim 21, further comprising a grid spirally disposed over the cathode, a spiral center of the grid being coincident with a central circular axis of the cathode.

23. The X-ray generation tube as claimed in claim 13, further comprising a cover connected to the first and second bases for commonly supporting the first and second pins.

* * * * *